United States Patent [19]

Pittman

[11] 4,193,747

[45] Mar. 18, 1980

[54] REVERSING PUMP ECCENTRIC MEMBER

[75] Inventor: Loyal V. Pittman, Bloomington, Minn.

[73] Assignee: Westinghouse Electric Corp., Pittsburgh, Pa.

[21] Appl. No.: 887,282

[22] Filed: Mar. 16, 1978

[51] Int. Cl.[2] ..... F04C 1/06; F04C 15/02; F16C 33/06

[52] U.S. Cl. ..... 418/32; 418/171; 308/172

[58] Field of Search ..... 418/32, 166, 170, 171; 417/315; 308/78, 106, 172

[56] References Cited

U.S. PATENT DOCUMENTS 3,497,273 2/1970 Muijderman et al. ..... 308/172

FOREIGN PATENT DOCUMENTS 1553281 9/1969 Fed. Rep. of Germany ..... 418/32

942634 11/1963 United Kingdom ..... 308/78

*Primary Examiner*—John J. Vrablik

*Attorney, Agent, or Firm*—F. A. Winans

[57] ABSTRACT

A reversing eccentric member for a gerotor pump is shown. The eccentric member comprises a ring having opposed generally planar surfaces. One surface defines an arcuate notch for limiting rotation of the member. The opposite surface defines a slightly-raised radially innermost marginal portion which is knurled to minimize the surface area that supports the member in facing engagement with a stationary plate of the pump and also define channels to prevent sticking between lubricated adjacent machined surfaces. This limits the frictional engagement between the stationary plate and the eccentric member and the adhesive tendency of the film of lubricant therebetween so the member is generally freely and easily rotated on the plate in response to a change in the direction of rotation of the pump rotor.

3 Claims, 3 Drawing Figures

REVERSING PUMP ECCENTRIC MEMBER

CROSS-REFERENCE TO RELATED APPLICATION

This application is related to the copending, commonly-assigned application Ser. No. 878,552, W. E. Case No. 47,609, filed Feb. 16, 1978, entitled "Reversible Gerotor Pump" and is another embodiment of an improvement described therein. Insofar as the above-identified copending application generally describes the prior art and specifically describes a reversible gerotor pump, it is herein incorporated by reference.

SUMMARY OF THE INVENTION

A reversing eccentric member of the gerotor pump is sandwiched, in facing engagement, between stationary plates within the pump housing. As the friction between the rotating rotor and the eccentric member is relied upon to properly position the eccentric member in either one of two indexed positions, the friction between the eccentric member and the facing plates that might prevent or impede such movement of the eccentric member must be minimized. Also, the adhesive tendency of the lubricant film therebetween must also be minimized or eliminated. To accomplish this, the normally flat face of the eccentric member opposite the face having the indexing notch, has a radially innermost marginal portion projecting outwardly from the remaining surface to limit the surface area of contact between the eccentric member and the adjacent stationary plate. This outward surface area is further reduced by a machining process as by knurling, resulting in a substantially flat outermost reduced surface area to minimize friction that tends to prevent movement of the eccentric member and to define channels for establishing a lubricant film thickness that can easily be separated for moving the parts easily relative to each other.

DESCRIPTION OF THE PREFERRED EMBODIMENT

Figure 1:
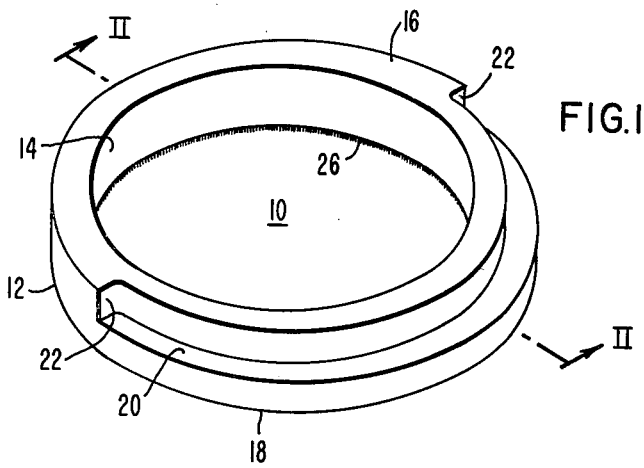
FIG. 1 is an isometric view of the reversing eccentric member.
Figure 2:
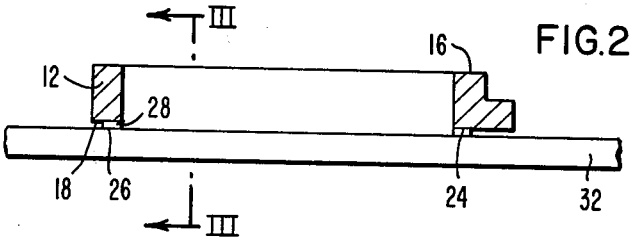
FIG. 2 is an elevational cross-sectional view of the reversing eccentric member.
Figure 3:
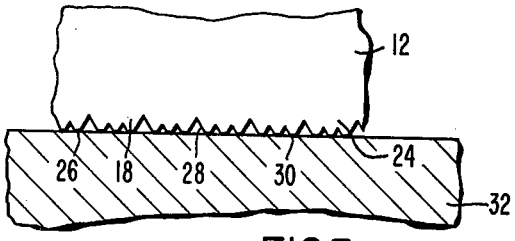
FIG. 3 is an enlarged view of the profile of a knurled portion of the member.

Referring to the Figures, the reversing eccentric member 10 is seen to comprise a substantially cylindrical ring having a circular outer peripheral wall 12 and a circular inner wall 14, a planar upper surface 16 and an opposed lower surface 18. It will be noted that the circular walls 12, 14 are not concentric thereby defining an eccentric configuration. Also, the outer peripheral portion of the upper surface 16 is notched as at 20 over a 180° arcuate extent defining shoulders 22 to abut a stationary pin in the pump to index the rotation of the member 10.

The lower surface 18 is substantially planar except for an annular inner marginal portion 24 which projects slightly outwardly from the surface 18 to form a raised surface 26.

Surface 26 is machined such as by knurling to reduce the total area of the outermost extending surface. The knurling produces generally radially extending indentations or channels such as at 28 in the surface 26 which extend completely through the raised portion; however, the outermost crests 30 of the surface are flat and in a common plane substantially perpendicular to the walls 12, 14 to prevent cocking or an askewed orientation of the member as supported on an adjacent facing planar plate 32 of the pump by the crest 30.

Thus, the surface 26 which, in the assembled pump, is in facing engagement with an adjacent stationary plate 32, provides minimum contact therebetween to minimize the frictional engagement that impedes rotation of the member. The channels 28 also prevent the tendency of the surface 26 to stick to the surface of the facing adjacent plate by virtue of the film of lubricant normally existing therebetween the channels permit a sufficiently thick film that is easily broken by relative movement of the parts.

The raised portion can be formed any of various ways, such as initially fabricating (casting or forging) the member with a raised marginal portion and subsequently machining the exposed surfaces to the desired finish or by forming the member to a constant thickness and removing by machining the outer material on the lower surface except for the marginal portion which is then subsequently knurled. For purposes of testing the operation of such a member within a gerator pump, the latter method was used to fabricate the member.

What is claimed is:

1. A reversing eccentric member for a pump or the like, said member defining a ring having an outer circular wall and an inner circular wall which are not concentric, a generally planar upper surface and a generally planar bottom surface, said bottom surface having an annular marginal area adjacent the inner circular wall projecting outwardly from the normal plane of the surface, said area having indentations forming channels extending completely across said area to enhance lubrication film shearing when said ring is rotated relative to a facing plate resulting in a raised bearing surface of reduced area and wherein said raised surface is substantially flat and in a plane perpendicular to said walls.

2. A reversing eccentric member for a fluid pump, said member being generally cylindrical and defining an off-center central opening and generally planar top and bottom surfaces and wherein said bottom surface provides a bearing surface on which said member is supported while rotated on an adjacent stationary planar surface and defines an annular portion projecting outwardly from the normal plane thereof having machined channel-like indentations extending across said portion for reducing the surface area supporting said member on said stationary surface and enhancing lubrication film shearing as said ring is rotated relative to said stationary surface, said outwardly projecting portion providing a reduced area bearing surface for reduced frictional engagement between said member and said stationary surface.

3. Structure according to claim 2 wherein said annular portion is adjacent said opening.

* * * * *